US005136143A

United States Patent [19]

Kutner et al.

[11] Patent Number: 5,136,143

[45] Date of Patent: Aug. 4, 1992

[54] COATED CARTRIDGE HEATER

[75] Inventors: Samuel J. Kutner, Lake Quivera, Kans.; Herman B. Turner, Jr., Kansas City, Mo.

[73] Assignee: Heatron, Inc., Leavenworth, Kans.

[21] Appl. No.: 715,563

[22] Filed: Jun. 14, 1991

[51] Int. Cl.[5] ..... H05B 3/44

[52] U.S. Cl. ..... 219/544; 219/523; 219/534; 338/238

[58] Field of Search ..... 219/523, 544, 534, 530, 219/540, 538, 546; 338/238–248

[56] References Cited

U.S. PATENT DOCUMENTS

| | | | |
|---|---|---|---|
| 3,663,799 | 5/1972 | McArn | 219/523 |
| 3,965,808 | 6/1976 | Chomette | 219/221 |
| 4,115,686 | 9/1978 | Williams et al. | 219/523 |
| 4,120,086 | 10/1978 | Crandell | 29/611 |
| 4,227,535 | 10/1980 | Connor | 219/504 |
| 4,300,038 | 11/1981 | Schwarzkopf | 219/544 |
| 4,492,556 | 1/1985 | Crandell | 219/523 |
| 4,514,160 | 4/1985 | Davidsmeyer | 425/143 |
| 4,711,625 | 12/1987 | Knauer et al. | 219/421 |
| 4,841,127 | 6/1989 | Prager et al. | 219/225 |
| 4,875,845 | 10/1989 | Hara et al. | 425/143 |
| 5,013,890 | 5/1991 | Gamble | 392/497 |

OTHER PUBLICATIONS

Willis, Jr., David P.; "Fighting Friction with Bonded Coatings", Brochure distributed by Whitford Corp., Reprinted from the Apr. 10, 1980, *Machine Design Magazine.*

*Primary Examiner*—Geoffrey S. Evans
*Assistant Examiner*—Michael D. Switzer
*Attorney, Agent, or Firm*—Litman, McMahon & Brown

[57] ABSTRACT

An improved cartridge heater comprising a electrical resistance heating wire coil enclosed in a stainless steel cylindrical sheath and having bonded thereto a coating containing a solid lubricant and a binder. The solid lubricant providing for ease of removal of the cartridge heater from a bore hole into which it has been inserted for use and providing a barrier to corrosion between the cartridge heater and the metal of the apparatus in which the bore hole is located.

10 Claims, 1 Drawing Sheet

1
2
3
5
6
7
9
10
11
15
16
17
18
20
25
30
31

COATED CARTRIDGE HEATER

BACKGROUND OF THE INVENTION

The present invention relates to electrical cartridge heaters and in particular to a cartridge heater having a protective low friction coating.

Cartridge heaters are used to transmit heat to a wide range of equipment and apparatuses. Cartridge heaters are generally cylindrical and adapted to be inserted in appropriately dimensioned bore holes in apparatuses to be heated. A typical cartridge heater comprises a helically wound electrical heating element connected to two electrical leads and enclosed in a cylindrical or square metal sheath or casing, commonly made out of stainless steel.

In use, it is desirable to obtain a close fit between the cartridge heater and the bore hole in which the heater is inserted to ensure maximum heat transfer from the cartridge heater to the apparatus. A common problem in using currently available cartridge heaters in tight fitting bore holes is that the heaters often seize in the bore holes after operation. It is believed that seizure of the cartridge heater in the bore hole is caused by oxidation between the stainless steel casing of the cartridge heater and the metal of the bore hole. Seizure of the cartridge heater in the bore hole may also be caused by warping of the cartridge heater in the bore hole. A seized cartridge must be driven out of the hole or in some cases drilled out. The heater is usually destroyed in this process and the equipment in which the cartridge heater was seized may be damaged in removing the cartridge.

Attempts have been made to facilitate removal of cartridge heaters from the bore holes in which they have been used. Liquid lubricants, such as oils, greases and solutions of magnesium and water have been applied to the stainless steel casings of cartridge heaters prior to insertion into a bore hole to facilitate later removal. Although liquid lubricants are commonly used they prove to be inadequate.

If liquid lubricants are to be used, the user must purchase the cartridge heaters and the lubricants separately. The user must apply the lubricant themselves which can be a messy operation and if not properly supervised can be done inadequately. Due to the close fit between the cartridge heater and the bore hole, insertion of the cartridge heater in the bore hole often results in the liquid lubricant being forced away from the surface of the cartridge heater, exposing the surface of the cartridge heater to the metal defining the bore hole such that the metal to metal contact would be subject to oxidation. Also, once the lubricated cartridge heater is inserted in the bore hole, the liquid lubricant would tend to migrate toward low spots exposing the metal surface of portions of the cartridge heater to direct contact with the metal defining the bore hole so as to allow oxidation.

SUMMARY OF THE INVENTION

The present invention comprises a cartridge heater having a solid lubricant bonded to an outer surface of the cartridge heater. The cartridge heater is typically cylindrical and comprises a resistance wire helically wound around a ceramic core or spirally threaded through the ceramic core and then enclosed in a stainless steel casing. A dielectric material separates the resistance wire from direct contact with the stainless steel casing. The cartridge heater is adapted to be inserted in a bore hole of an apparatus or piece of equipment to be heated.

The solid lubricant is formulated with a resin binder and a solvent and then applied to the cartridge heater casing in a thin layer or coating. The coating may be applied by spraying, dipping, brushing or by other suitable means. Prior to application of the coating the surface of the cartridge heater is preferably treated by cleaning, degreasing, sand blasting or grinding to improve adherence of the coating to the surface. After the coating is applied to the cartridge heater casing, the coating is cured by baking.

The cartridge heaters with the solid lubricant bonded thereon are delivered to the user ready for use. The user does not have to pretreat the cartridge heater with a messy lubricant prior to insertion in the selected bore hole. Once the cartridge heater is inserted in the bore hole, the coating of the solid lubricant separates the metal surfaces of the cartridge heater casing and the bore hole so as to prevent oxidation and reduces friction for ease in removal or release of the cartridge heater from the bore hole. Typically a cartridge heater is only removed when it fails.

OBJECTS AND ADVANTAGES OF THE INVENTION

Therefore, it is an object of the present invention to provide a cartridge heater that is easily removable from a bore hole in which it has been used; to provide such a cartridge heater that does not seize within the bore hole; to provide such a cartridge that does not oxidize within the bore hole; to provide such a cartridge heater having a lubricant bonded thereto; to provide such a lubricated cartridge heater that is readily packageable and transportable; to provide such a lubricated cartridge heater wherein the lubricant retains its lubricating properties even when the cartridge heater operates at temperatures up to 1200° Fahrenheit.

It is a further object of the present invention to provide a formulation including a lubricant that is readily bound to a cartridge heater; to provide such a formulation having an aqueous solvent; to provide such a formulation that may be applied to said cartridge heater by spraying dipping or the like; to provide such a formulation which may be applied to a cartridge heater in a relatively thin coat; to provide such a formulation that allows easy removal of the cartridge heater from a bore hole in which it has been used; to provide such a formulation which prevents oxidation between the metal of the cartridge heater and the metal defining the bore hole; to provide such a formulation which is relatively inexpensive to make, easy to apply, and particularly well adapted for its intended usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figures 1, 2, 3:
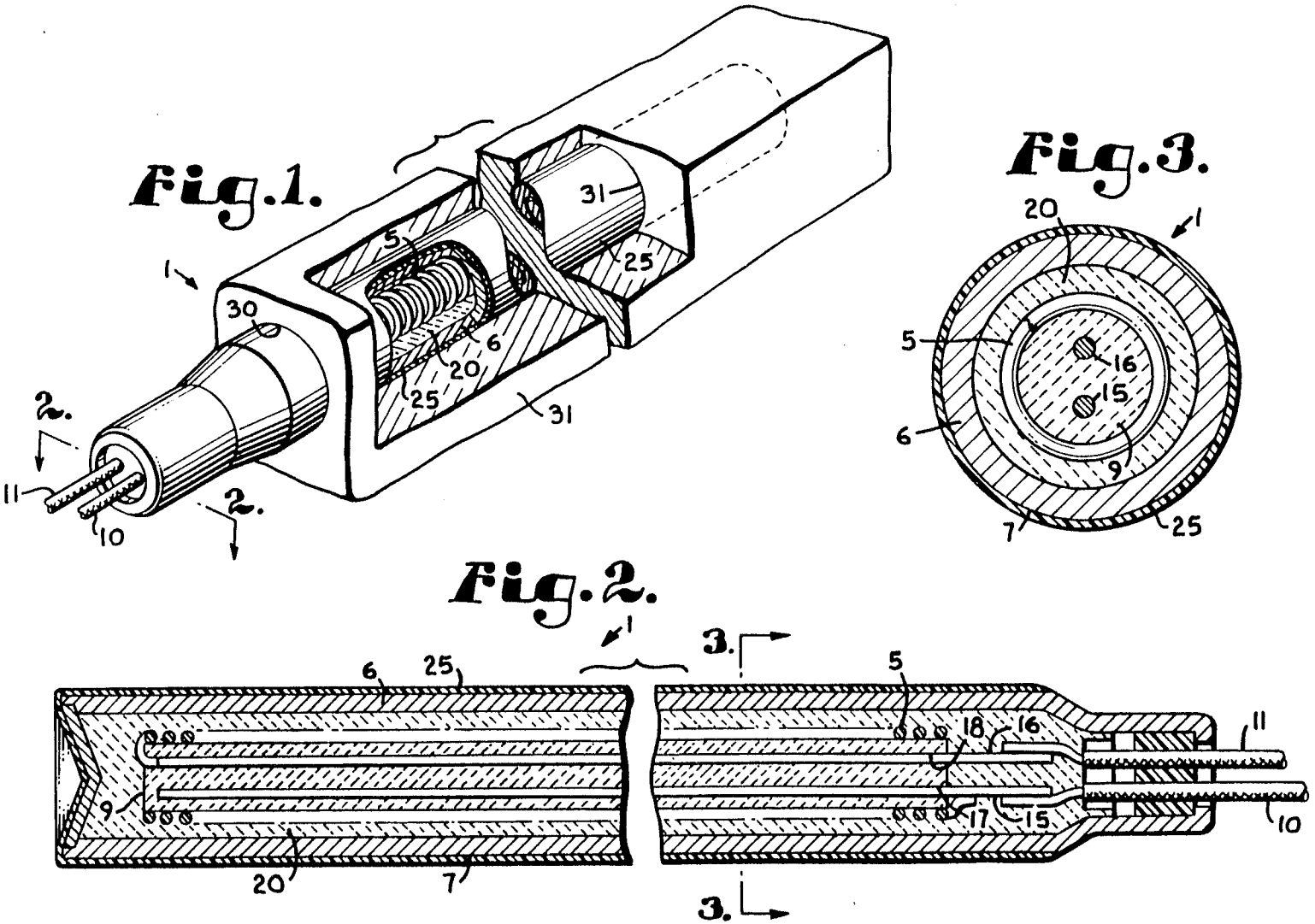
FIG. 1 is a fragmentary, perspective view of a coated cartridge heater of the present invention with portions broken away to show interior details thereof, shown inserted into a bore hole of a object to be heated by the cartridge heater.
FIG. 2 is an enlarged and fragmentary, cross-sectional view of the coated cartridge heater taken along line 2—2 of FIG. 1.
FIG. 3 is an enlarged cross-sectional view of the coated cartridge heater taken along line 3—3 of FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail the reference numeral 1 generally represents a coated cartridge heater. The coated cartridge heater comprises an electrical resistance heating means such as a helically wound resistance wire or heating conductor 5 enclosed in a cylindrical sheath or casing 6 having an outer surface 7. The resistance wire 5 is wound about a core 9 which is made of an insulating material, particularly ceramic material. Ends of the resistance wire 5 are connected to electrical leads 10 and 11 by electrical connection means such as connector pins 15 and 16 which extend through bores 17 and 18 in the core 9. The leads 10 and 11 extend out one end of the sheath 6.

The helically wound resistance wire 5 is preferably made from a nickel chromium alloy but other alloys may be used. A layer of dielectric material 20 such as high purity magnesium oxide grain insulates the thin space between the helically wound resistance wire 5 and the cylindrical sheath 6. During assembly of the coated cartridge heater 1, the cylindrical sheath 6 can be swaged so as to compress the layer of dielectric material 20 to provide optimum thermal transfer and electrical resistivity.

After the cylindrical sheath 6 has been swaged, a thin coating 25 of a lubricating formulation is applied to the cylindrical sheath 6 so as to form a dry film. The lubricating formulation generally comprises a solid lubricant, a binder or binding medium such as a resin binder and a solvent, preferably aqueous based. The components of the lubricating formulation are mixed together to form an emulsion and then applied to the cylindrical sheath 6 of the coated cartridge heater 1.

The preferred solid lubricant is molybdenum disulfide. Molybdenum disulfide has a melting point of 1185° Centigrade. It is believed that solid molybdenum disulfide retains its lubricating properties up to its melting point. Other potential solid lubricants for use in the lubricating formulation include fluoropolymers, ceramic materials, oxides and mineral powders such as graphite. Preferred fluoropolymers include tetrafluoroehtylene or polytetrafluoroethylene and fluorinated ethylene proylene It is foreseeable that the lubricating formulation may include more than one of the solid lubricants discussed above. It is foreseeable that other solid lubricants may be used in the lubricating formulation.

Preferred resin binders that are compatible with an aqueous solvent include polyphenylene sulfide and polyimide. Other resin binders that may be used include polyamideimide, polyphenylene sulfide, polyvinylidene fluoride, and polyacrylate or alkyd binders. It is foreseeable that for high operating temperatures of the cartridge heater 1, the resin binder may be replaced by an inorganic binder, such as ceramic based materials. The binders provide cohesive forces that hold particles of solid lubricant together and also provide adhesive forces that bond the coating to the outer surface 7 of the cylindrical sheath 6. Above a maximum operating temperature for each binder, the binder apparently destabilizes breaking the cohesive and adhesive forces or bonds.

Prior to application of the lubricating formulation, the outer surface 7 of the cylindrical sheath 6 is treated to ensure proper bonding of the solid lubricant to the outer surface 7 of the cylindrical sheath 6. The outer surface 7 of the cylindrical sheath 6 is cleaned and degreased. The outer surface 7 may also be sandblasted, ground, or treated by other means to provide a rough finish.

The lubricating formulation is preferably applied to the outer surface 7 of the cylindrical sheath 6 by spraying and in particular by an electrostatic spraying process. However, it is foreseeable that the lubricating formulation may be applied by other means such as dipping or brushing. After the lubricating formulation has been applied to the outer surface 7 of the cylindrical sheath 6, the coated cartridge heater 1 is baked at approximately 300° to 400° Fahrenheit for 10 to 15 minutes so as to partially cure the coating 25 of the lubricating formulation. Baking drives off the solvent and sets the binder such that the solid lubricant is bonded to the surface 7 of the cylindrical sheath 6. The coating 25, after it has been partially cured, has a thickness of approximately one one-thousandth of an inch. It is foreseen that the thickness of the coating 25 may vary. The coating 25 is fully cured during use when the coated cartridge heater 1 operates at a temperature which typically exceeds 400° Fahrenheit. The coating 25 is only partially cured initially to avoid damage or discoloration to exposed leads 10 and 11.

A coated cartridge heater 1 having solid lubricant bonded thereon is readily packageable and transportable because the bonded solid lubricant is not readily brushed off or removable from the outer surface 7 of the cylindrical sheath 6. Upon receipt, a user may insert the coated cartridge heater 1, having solid lubricant bonded thereon, directly into a bore hole 30 of an apparatus or piece of equipment 31 (not shown) adapted to receive the coated cartridge heater 1. The user does not have to lubricate the coated cartridge heater 1. Insertion of the cartridge heater 1 generally will not dislodge the coating 25 from the outer surface 7 of the cylindrical sheath 6. Also, storing the coated cartridge heater 1 for an extended period of time will not cause the coating to flake off.

In use the coated cartridge heaters 1 may operate at temperatures of up to 1200° Fahrenheit, however most coated cartridge heaters 1 operate at temperatures from 400° to 900° Fahrenheit. The operating temperatures for the cartridge heaters 1 typically exceed the maximum operating temperature for the binders. The coated cartridge heaters 1 are typically removed from the bore holes 30 they are used in only when the heaters 1 fail. Upon removal of the coated cartridge heaters 1, it is observed that during use, the coating 25 typically destabilizes, degrades or breaks down into a flaky skin-like shell or a powdery form. However, the coating 25 in the flaky or powdery form continues to exhibit lubricating properties of the solid lubricant and functions as a release means for providing ease in removal from the bore hole 30. Because the coated cartridge heater 1 generally remains stationary after insertion in a piece of equipment, the coating 25 in the flaky or powdery form does not appear to migrate, therefore the entire outer surface 7 of the cylindrical sheath 6 remains lubricated allowing easy removal or release of the cartridge heater 1 from the respective bore hole 30.

It is also believed that the coating 25 prevents oxidation between the stainless steel of the cylindrical sheath 6 and the metal of the apparatus or equipment 31 defining the bore hole 30 into which the coated cartridge heater 1 is to be inserted. Even when the coating 25 degrades into a flaky or powdery form, the coating 25 still apparently prevents such oxidation. The prevention of oxidation by the coating 25 contributes to the ease of removal of the cartridge heater 1 from the respective bore hole 30.

It is to be understood that while certain forms of the present invention have been illustrated and described herein, it is not to be limited to the specific forms or arrangement of parts described and shown.

What is claimed and desired to be secured by Letters Patent is as follows:

1. In combination with a metal apparatus having a bore hole and adapted to be heated to an operating temperature range, the improvement of a coated cartridge heater comprising:

(a) electrical resistance heating means;

(b) a sheath enclosing said electrical resistance heating means; and (c) release means for facilitating release of said cartridge heater from said bore hole, said release means having a first bonded condition wherein said release means is bonded to said sheath and a second release condition wherein said release means is separated from said sheath, said release means including temperature responsive condition altering means for altering a condition of said release means from said first bonded condition to said second release condition in response to elevated temperature within said operating temperature range.

2. The improved cartridge heater as described in claim 1 wherein:

(a) said solid lubricant retains lubricating properties after being heated to temperatures of up to 1200° Fahrenheit.

3. The coated cartridge heater as disclosed in claim 1 wherein:

(a) said solid lubricant comprises molybdenum disulfide.

4. The coated cartridge heater as disclosed in claim 1 wherein:

(a) said solid lubricant comprises graphite.

5. The coated cartridge heater as described in claim 1 wherein:

(a) said solid lubricant comprises a fluoropolymer.

6. The coated cartridge heater as described in claim 5 wherein:

(a) said fluoropolymer is selected from the group consisting of tetrafluoroethylene, polytetrafluoroethylene and fluorinated ethylene propylene.

7. The coated cartridge heater as described in claim 1 wherein:

(a) said solid lubricant comprises a ceramic lubricant.

8. The coated cartridge heater as described in claim 1 wherein:

(a) said solid lubricant comprises a mixture of at least two components selected from the group consisting of molybdenum disulfide, graphite, a fluoropolymer and a ceramic material.

9. The coated cartridge heater as described in claim 1 wherein said dry film further comprises:

(a) a binder.

10. The coated cartridge heater as disclosed in claim 9 wherein:

(a) said binder comprises a resin binder.

* * * * *